United States Patent [19]

Bourlier et al.

[11] 4,299,175

[45] Nov. 10, 1981

[54] LOCK CHAMBER FOR THE PASSAGE OF PACKETS OR OBJECTS BETWEEN A ROOM RESERVED FOR THE PUBLIC AND A PREMISES WHICH IS ISOLATED AND PROTECTED FROM THE PUBLIC

[76] Inventors: Claude P. Bourlier, 3 rue J. F. Belbeoch, 94410 Saint Maurice; Louis E. Sallot, 9 rue du Général Leclerc, 92270 Bois Colombes, both of France

[21] Appl. No.: 120,943

[22] Filed: Feb. 12, 1980

[30] Foreign Application Priority Data

Feb. 16, 1979 [FR] France ..... 79 03963

[51] Int. Cl.[3] ..... E05G 7/00

[52] U.S. Cl. ..... 109/19; 109/48

[58] Field of Search ..... 109/48, 45, 8, 11, 13, 109/16, 73, 3, 5, 19; 312/211, 212; 232/43.3, 43.4

[56] References Cited

U.S. PATENT DOCUMENTS

| | | | |
|---|---|---|---|
| 1,091,556 | 3/1914 | Bartels | 109/48 |
| 1,346,823 | 7/1920 | Hecht | 109/19 |
| 1,348,673 | 6/1920 | Hecht | 109/19 |
| 2,548,338 | 4/1951 | Behrens | 232/43.3 |
| 3,285,209 | 11/1966 | Pace | 109/8 |
| 4,157,071 | 6/1979 | King | 109/11 |

*Primary Examiner*—Reinaldo P. Machado
*Attorney, Agent, or Firm*—James C. Wray

[57] ABSTRACT

The lock chamber is employed for the passage of packets or large-sized objects between a room reserved for the public and a premises which is isolated and protected from the public by a safety partition wall. It may be for example employed in administrative services such as post-offices, departmental stores or left-luggage offices of stations or airports, etc.

In this lock chamber, the drum has at least one window closed by a transparent bullet-proof material. This window is diametrally opposed to the access opening for supervising the exchange. The drum has end-of-travel abutments and locking means which automatically fix the drum in any one of its loading or unloading positions.

12 Claims, 6 Drawing Figures

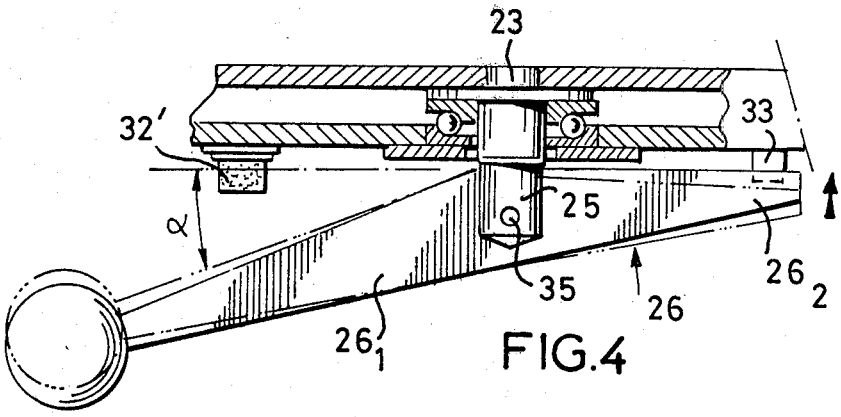
FIG.4
FIG.5
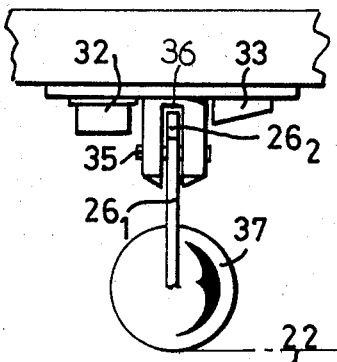
FIG.6
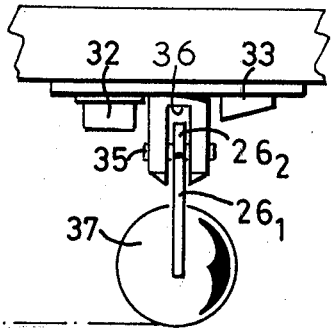
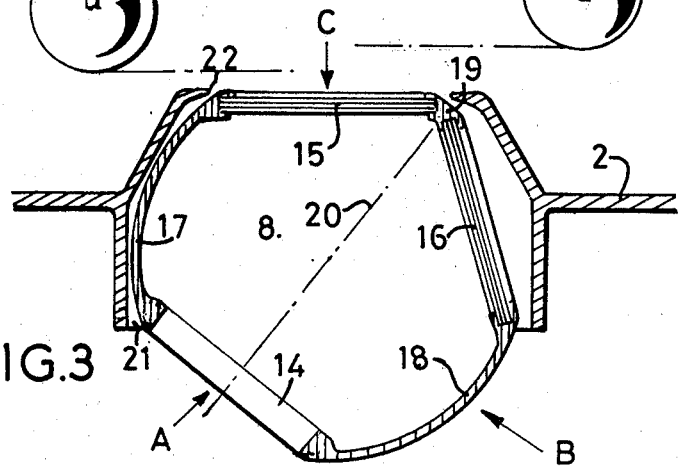
FIG.3

LOCK CHAMBER FOR THE PASSAGE OF PACKETS OR OBJECTS BETWEEN A ROOM RESERVED FOR THE PUBLIC AND A PREMISES WHICH IS ISOLATED AND PROTECTED FROM THE PUBLIC

The invention relates to a lock chamber for the passage of large-sized packets or objects between a room reserved for the public and a premises which is isolated and protected from the public by a safety partition wall, used for example in administrative services such as post-offices, departmental stores, and left-luggage offices of stations, or airports, etc.

Such lock chambers are already known and are adapted to equip service windows of administrative services receiving or dispatching objects or packets, these lock chambers usually consisting of a box structure provided with two confronting openings fixed in the region of an opening formed in the partition wall separating the official from the public, this box structure receiving a rotary drum which is also provided with an opening which is brought selectively in alignment with one or the other opening of the box structure located on the official's side or the public's side.

This type of lock chamber has many drawbacks related to the fact that the exchanges occur "blind" and that, furthermore, the drum is mounted to be freely rotatable with no locking means so that the public can rotate the drum at will without possibility for the official to be in charge of and to check the handling of the operations. This is an especially serious drawback inasmuch as the drum is "blind" and the official is consequently not aware of the object in the presence of which he will find himself when the opening of the drum will appear before him, which constitutes a serious inconvenience in the presence of present policy which is, on the contrary, directed towards the systematic checking of the objects being transferred so as to avoid danger of criminal behaviour.

An object of the invention is to overcome the drawback of known devices and for this purpose provides to a lock chamber which is designed to allow good visibility of the exchange without however diminishing the safety of the official, this lock chamber being moreover provided with locking and fixing means operated by the official alone, so that any offending action on the part of the public is avoided.

The invention provides a lock chamber for the passage of packets or objects between a room reserved for the public and a premises which is isolated and protected from the public by a safety partition wall, this lock chamber comprising a rotary drum provided with at least one opening giving access to the interior of the drum, wherein the drum comprises at least one viewing window which is closed by a transparent bullet-proof material, said window being diametrally opposed to the access opening for supervising the exchanges, said drum further comprising end-of-travel abutments and locking means which automatically fix the drum in any one of its loading or unloading positions.

In a simplified first embodiment, the drum comprises two diametrally opposed curved walls and two confronting planar sides defining the access opening and viewing window.

In a modification which may be used in particular when there are two officials, the drum comprises an access opening and two viewing windows which windows are separated by a section member located on the medium axis of the opening but in a plane which is diametrally opposed to the plane of said opening.

Further features and advantages of the invention will be apparent from the ensuing description with reference to the accompanying drawings in which:

FIG. 3 is a diagrammatic plan view of a modification in which the rotary drum has an access opening and two viewing windows;

FIG. 4 is a sectional view illustrating the pivoting lever and,

FIGS. 5 and 6 are diagrammatic views of the pivoting lever in its locked and unlocked positions respectively.

Figure 1:
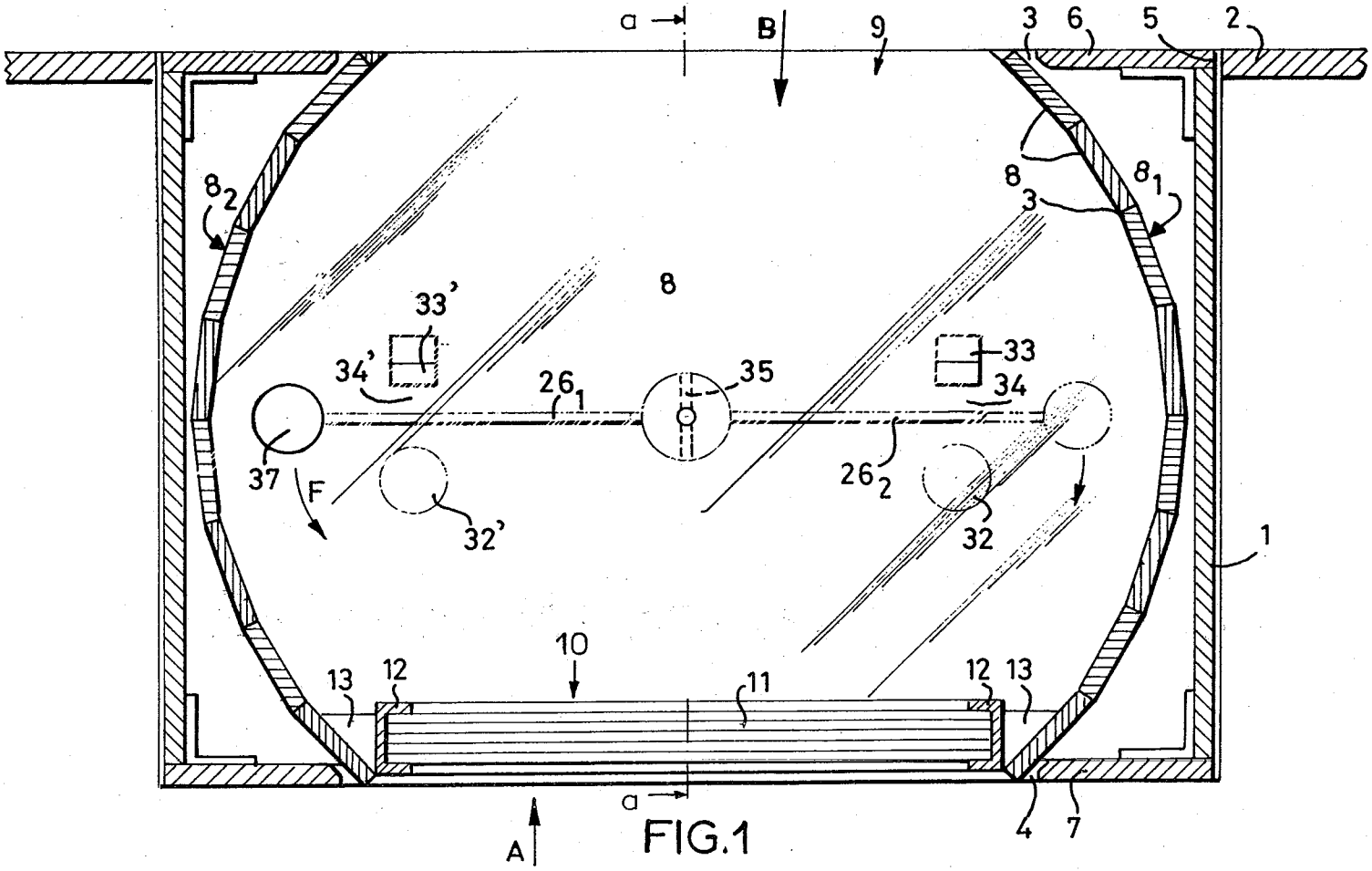
FIG. 1 is a view partly in plane and partly in section of the lock chamber according to a first embodiment.

The lock chamber according to the invention comprises a box structure 1 located within the premises or office of the official, this box structure being connected to the partition wall 2 which separates the official from the public. In the embodiment illustrated in FIG. 1, the box structure has a parallel-sided shape and has two openings 3 and 4 on two opposite sides, the opening 3 coinciding with the aperture 5 formed in the partition wall 2. This box structure is made from sheet metal and comprises flanges 6 and 7 which define the openings 3 and 4 and permit access alternately to the interior of a rotary drum 8 which is also provided with an opening 9 which permits the introduction of objects in the drum or their extraction, depending on whether this opening 9 is facing the official or the public.

According to the invention, the drum 8 is rotatably mounted and has a second opening 10 which is closed by a bullet-proof transparent material such as bullet-proof safety glass, so that the drum remains perfectly sealed and yet permits a checking and supervision of the exchanges. This material may be formed by a plurality of thicknesses of juxtaposed sheets of glass 11 which are inserted in two U-section members 12. This opening 10 forms a sealed viewing window which, owing to the fact that it is diametrally opposed to the opening 9 and is located in a plane parallel to this opening, enables the official to check and supervise very carefully the transfer of the objects or packets, the dimensions of the viewing windows providing him a full view of the whole volume of the drum.

In the embodiment illustrated in FIG. 1, the drum consequently comprises two curved walls $8_1$ $8_2$ which are in facing relation to each other and two openings which have substantially similar dimensions which are also facing relation to each other. The curved walls $8_1$ $8_2$ may be made from vertical metal strips $8_3$ which are screwed to the walls $8_4$ and $8_5$ of the drum which constitute respectively the bottom and the cover of the drum. These curved walls $8_1$ $8_2$ may be stiffened by rendering the metal strips $8_3$ rigid with each other by tongue and groove assembles of the type used for floor boards. This latter assembly of the metal strips $8_3$ renders them rigid with each other and precludes a voluntary twisting or deformation thereof.

In the modification shown in FIG. 3, the box structure 1 may have a quite different shape and the rotary drum 8 may comprise, for reasons of utilisation, not one viewing window but two, in particular in the case where two officials are employed for the service. In this embodiment, the drum 8 has a shape of pentagon formed by an opening 14 providing access to the interior of the drum, two viewing windows 15 and 16 connected to the opening 14 by two curved sectors 17 and 18. The two viewing windows 15 and 16 are, like the window 11 shown in FIG. 1, closed by bullet-proof safety glass and are located on each side of an upright section member 19 located in the median plane 20 of the opening 14 but in diametrally opposed ralation. Diagrammatically, it may be considered that each of the sides of the pentagon make an angle of 72° therebetween so that the two viewing windows 15 and 16 make an angle of about of 140°, this angle being substantially equal to the opening 21 formed in the box structure on the official's side. On the other hand, the opening 22 on the public side has a width substantially equal to one of the sides of the pentagon, i.e. approximately equal to the width of the access opening 14 or of a viewing window 15 or 16. This type of drum is particularly adapted to the case where the premises isolated from the public room receives two officials, since it is thus possible to bring the opening 14 providing access to the interior of the drum either in alignment with the entrance A corresponding to one official or in alignment with the entrance B corresponding to the other official. This design, and more particularly the disposition of the opening 14 with respect to the viewing windows 15 and 16 ensures that the drum always performs the function of a lock chamber while it permits a full checking and supervision of the exchanges, whether the access opening be located at A, at B, (officials' side), or at C (public side). Indeed, when the opening of the drum 14 is in alignment with the station A, the opening 22 of the box structure is closed by the viewing window 15 whereas, when the opening 14 is in alignment with the station B, the opening 22 of the box structure is closed by the viewing window 16. When the opening 14 of the drum is brought by a rotation of the drum in alignment with the station C, the officials are completely isolated from the public, since the opening 21 of the box structure (on the officials' side) is closed by the two viewing windows 15 and 16. The objects are therefore placed in the drum 8 while the drum is completely physically sealed off and the officials can supervise the nature of the object placed in the drum. In the same way as in the embodiment shown in FIG. 1, the viewing windows 15 and 16 are closed by transparent material such as layers of bullet-proof glass and the curved sectors 17 and 18 may, here again, be constructed in the form of metal strips which fit one inside the other and are assembled with the bottom and cover walls of the drum.

Figure 2:
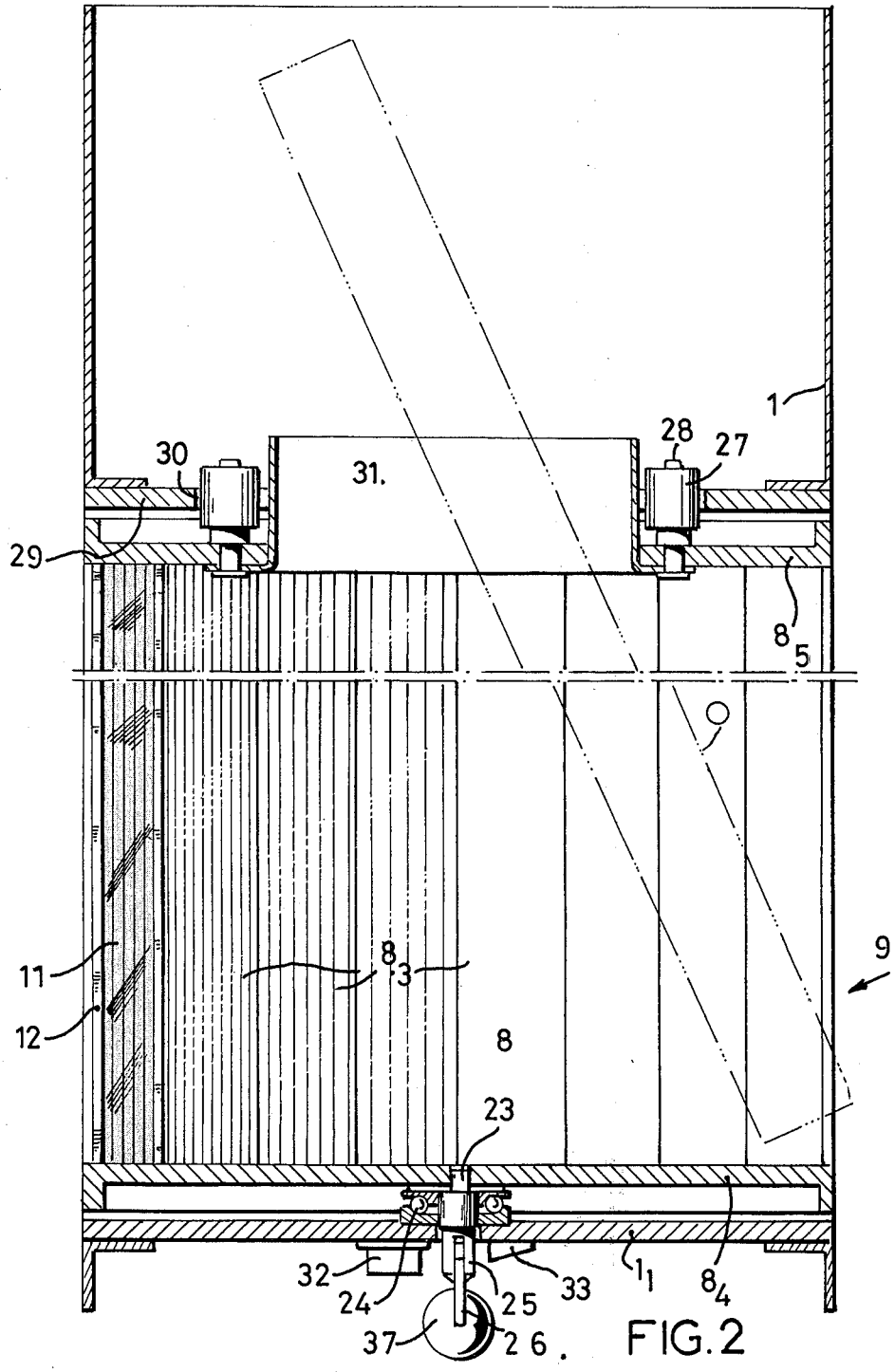
FIG. 2 is a vertical sectional view taken on line a—a of FIG. 1.

As mentioned before, the drum is mounted to be rotatable about a vertical axis and the means for rotating the drum comprise as shown in FIG. 2, a shaft 23 rigid with the bottom $8_4$ of the drum supported by a ball-bearing 24. This shaft 23 is extended at 25 beyond the bottom $8_4$ of the drum and is connected to a shifting lever 26. The ball bearing 24 takes the whole weight of the drum but the drum is guided in its upper part by rollers 27 which are freely rotatable on spindles 28 rigid with the cover $8_5$ of the drum. These rollers freely roll along the fixed part 29 of the box structure which has for this purpose a bore 30 forming a raceway for the rollers. The cover $8_5$ of the drum is provided with a sleeve 31 which opens onto the upper part of the box structure 1, so that narrow objects having a height considerably exceeding the height of the drum may be introduced diagonally through the opening 9 or 14 of the drum. This design permits the use of drums having a smaller height than the box structure so that their weight may be reduced and the supporting and driving means may be relieved of a certain amount of this weight, it being understood that this weight is relatively considerable owing to the presence of the viewing windows and more particularly the considerable thick bullet-proof glass.

The objects O placed in the drum rest by their base on the bottom $8_4$ of the drum and rotate with the drum and the sleeve 31 with no hindrance or deterioration of the object.

Further, the lock chamber according to the invention comprises automatic means for locking and fixing the drum in one of the operative positions thereof, whether it concerns the embodiment illustrated in FIG. 1 or that illustrated in FIG. 3.

One embodiment of the locking and fixing means applicable to the embodiment of FIG. 1 is illustrated in FIGS. 4, 5 and 6.

In this respect, the bottom wall 11 of the box structure is provided (FIG. 1) with end-of-travel abutments 32 and raising cams 33 in facing relation to each other, so that one pair of abutments and cams define therebetween a gap 34 constituting a locking recess for the shifting lever 36. In this embodiment, the two abutments 32 are in alignment in the same plane of the drum which is parallel to the access opening 9 and to the viewing window 11, and the two cams 33 are also located in the same plane of the drum which is also parallel to the opening and window. The lever 26 has the feature (FIG. 4) of being pivotally mounted on a pin 35 perpendicular to the extension 25 of the shaft 23, this extension being provided with a diametral slot 36 in which the pivotal lever 26 is located so that the lever, the shaft 23 and the drum are connected to rotate together. This lever has two arms $26_1$, $26_2$, the first mentioned arm being longer than the second and having ballast so that the arm $26_2$ is always biased upwardly. Further, this arm $26_1$ makes an angle $\alpha$ with the horizontal so that it does not encounter the abutments 32 or cams 33 which would otherwise be in its path. On the other hand, the upper part of the arm $26_2$ on this lever is very close to the horizontal so that it encounters the cams 33 which are vertically shorter than the abutments 32, which is an important feature.

These locking and fixing means operate in the following manner:

With reference to FIG. 1, and assuming that the side A is the official's side and that the side B is the public side, and if it is assumed that, upon assembly the pivotal lever 26 was oriented in such manner that its shifting knob 37 (which is the ballast part of the arm) is located on the left side of the Figure, and if it is further assumed that this lever must rotate from the left to the right in the direction of arrow F (FIG. 1), it will be understood that, in this position, the arm $26_2$ of this lever is locked in the recess 34 formed between the abutments 32 and 33 located on the right side of the drawing owing to the fact that the weight of the arm $26_1$ biases the arm $26_2$ upwardly as mentioned before. If the official then desires to allow a rotation of the drum through 180° so as to bring the access opening 9 to the position and place of the viewing window 11 and vice versa, he must necessarily raise the arm $26_1$ of the lever so as to swing the arm $26_2$ downwardly and bring it from the position in FIG. 5 to the position shown in FIG. 6. In this position, the arm $26_2$ escapes from the cam 33 which is facing it and can consequently freely pivot in the counterclockwise direction. Owing to its angle $\alpha$ spacing it away from the abutments 32', the arm $26_1$ does not encounter the latter. After a rotation of nearly 180° of the lever and the drum rigid therewith, the arm $26_1$ of the lever encounters the ramp $33_1$ of the cam, designated for reasons of clarity 33', and shifts the end of this lever downwardly and brings it into the locking recess 34' where it encounters the abutment 32' which is as mentioned before, longer than the cam 33'. The arm $26_1$ of the lever then encounters the shock-absorbing abutment 32' and is then automatically locked in the recess 34' as soon as the official releases the lever 26, this locking being achieved simply by the effect of gravity, i.e. owing to the imbalance of the lever whose arm $26_1$ is heavier. In this position, the official can again rotate the drum through 180° by once again unlocking the lever by merely raising the arm $26_1$ and disengaging the arm $26_2$. This corresponds to an alternating rotation in one direction and in the other solely under the control of the official.

This manner of locking and fixing may of course be employed in the embodiment of FIG. 3, only the position of the cams and abutments being changed so as to satisfy, not two but three locking positions equally spaced apart.

This type of lock chamber has many advantages, since not only does it permit transactions and exchanges of objects in full view, it can also and above all be locked and fixed in its various positions of use without it being possible for members of the public to rotate the drum on their own initiative. The construction of the materials of the lock chamber have been particularly chosen to suit contemporary materials employed in the decoration and equipment of modern offices.

It must be understood that the scope of the invention is not intended to be limited to the embodiment described hereinbefore in respect of which other modifications may be envisaged without departing the scope of invention.

We claim:

1. A lock chamber structure for the passage of packets or objects, between one side and the opposite side of a partition wall which defines an opening, the structure comprising a drum which is mounted to be rotatable relative to the partition wall about an axis and comprises two curved walls which are tangent to edges of said opening and are in confronting relation on opposite sides of said axis, said curved walls defining therebetween an access opening for giving access to the interior of the drum and at least one bullet-proof glass viewing window the access opening and the viewing window being capable of being brought selectively in facing relation to and substantially in the plane of said opening in the partition wall by rotation of the drum about said axis, means for controlling the rotation of the drum and means for immobilizing the drum in a loading position and in an unloading position.

2. A lock chamber as claimed in claim 1, comprising a box structure fixed in alignment with the opening in the partition wall and defining two openings in confronting relation to each other, the curved walls having a width which is substantially equal to the width of the box structure transversaly of the partition wall, the drum having a part cylindrical shape and disposed in the box structure.

3. A lock chamber as claimed in claim 2, wherein the two curved walls define a single viewing window of bullet-proof safety glass which is diametrally opposed to the access opening relative to said axis.

4. A lock chamber as claimed in any one of the claims 1, 2 or 3, wherein the curved walls are made from planar metal strips which are assembled with each other on a curvilinear contour.

5. A lock chamber as claimed in claim 4, wherein the drum has a bottom wall and a cover wall and screws assemble the strips with the bottom wall and the cover wall, tongues and grooves being provided on vertical edges of the strips and interengaged and constituting a rigid and undeformable assembling of the strips.

6. A lock chamber as claimed in claim 1, comprising a box structure fixed in alignment with the opening in the partition wall, the drum being rotatably mounted in the box structure and having a top cover wall which defined a large aperture in which is mounted a sleeve which opens onto an upper part of the box structure so as to permit the introduction of narrow objects which have a height exceeding the height of the drum and can extend through the sleeve, whereby the effective height and the weight of the drum may be reduced.

7. A lock chamber as claimed in claim 1, wherein the drum comprises one access opening and two viewing windows, a section member located in the median plane of the access opening but in diametrally opposed relation to the access opening relative to said axis being interposed between the two viewing windows.

8. A lock chamber as claimed in claim 2, wherein the box structure has a fixed bottom and said means for controlling the rotation of the drum and said means for immobilizing the drum comprise end-of-travel abutments formed by shock-absorbing pads carried by the fixed bottom, a ballasted pivotal lever associated with the drum and at least two cams each provided with a ramp and fixed on the rigid bottom in the vicinity of the abutments so as to define with the abutments a locking recess into which the pivotal lever can be locked by pivoting merely under the effect of gravity.

9. A lock chamber as claimed in claim 8, comprising pivot means rigid with the drum and defining said axis of rotation, said lever being pivotally mounted on said pivot and comprising a shifting arm portion and a locking arm portion, said shifting arm portion being heavier than the locking arm portion so as to bias the locking arm portion constantly upwardly, i.e. towards the rigid bottom of the box structure.

10. A lock chamber as claimed in claim 8, wherein the drum has only one access opening and one viewing window, the two abutments are in alignment in a common plane of the drum and the two cams are in alignment in a common plane of the drum, the plane of the abutments and the plane of the cams being parallel and close to each other and parallel to the opening and to the viewing window and to the pivotal lever when the lever is locked in one of its two positions in the locking recesses.

11. A lock chamber as claimed in claim 2, wherein the box structure has a bottom provided with a ball bearing which supports the rotary drum, and the box structure has an upper wall defining, a bore which roll rollers which are freely rotatable on spindles rigid with the drum being in rolling engagement with the upper wall defining the bore.

12. A lock chamber as claimed in claim 7, wherein the box structure comprises means defining a first opening and projecting through said opening in the partition wall on a public side of the partition wall and two second openings located on officials' side of the partition wall and pertaining to two working stations.

* * * * *